US006296180B1

(12) United States Patent
Blizzard

(10) Patent No.: US 6,296,180 B1
(45) Date of Patent: Oct. 2, 2001

(54) POSTAL BOX COVERING

(76) Inventor: Clarence E. Blizzard, 2840 Forest Hills Rd., Petersburg, VA (US) 23805

( * ) Notice: Subject to any disclaimer, the term of this patent is extended or adjusted under 35 U.S.C. 154(b) by 0 days.

(21) Appl. No.: 09/574,128

(22) Filed: May 19, 2000

(51) Int. Cl.[7] ..... B65D 91/00
(52) U.S. Cl. ..... 232/38; 232/39
(58) Field of Search ..... 232/38, 39, 17, 232/45; D99/29, 30, 31; 150/154; 217/51; 52/3, 5

(56) References Cited

U.S. PATENT DOCUMENTS

| | | | | |
|---|---|---|---|---|
| D. 256,751 | | 9/1980 | Crawford et al. . | |
| D. 287,899 | * | 1/1987 | Lindheimer | D99/30 |
| D. 385,677 | * | 10/1997 | Vivirito, Jr. | D99/29 |
| 3,107,848 | | 10/1963 | Penta . | |
| 4,368,842 | | 1/1983 | Delange, III . | |
| 4,375,869 | * | 3/1983 | Hatch | 232/17 |
| 4,991,769 | * | 2/1991 | Todd | 232/17 |
| 5,035,356 | | 7/1991 | Granger . | |
| 5,054,685 | * | 10/1991 | Roach | 232/17 |
| 5,106,016 | | 4/1992 | Beckmann . | |
| 5,435,483 | | 7/1995 | Cox . | |

* cited by examiner

*Primary Examiner*—B. Dayoan
*Assistant Examiner*—William L. Miller

(57) ABSTRACT

A postal box covering for protecting a postal box from the elements of weather. The postal box covering includes a plurality of elongate members. Each of the elongate members has a longitudinal axis. Each of the elongate members has a first side, a second side, a third side, a fourth side, a first end and a second end. The elongate members are generally oriented parallel to each other. The elongate members are between a first and a second elongate member. A plurality of straps bind the elongate members together. Each of the straps is adjacent to each of the second sides of the elongate members. A plurality of fastening devices fasten the straps to the elongate members. A plurality of mountings are fixedly coupled to the first and second elongate members. A plurality of brackets have a base portion and two arm members extending therefrom. The arm members are oriented generally parallel to each other and are spaced. One of the arm members is releasably coupled to each of the mountings.

8 Claims, 2 Drawing Sheets

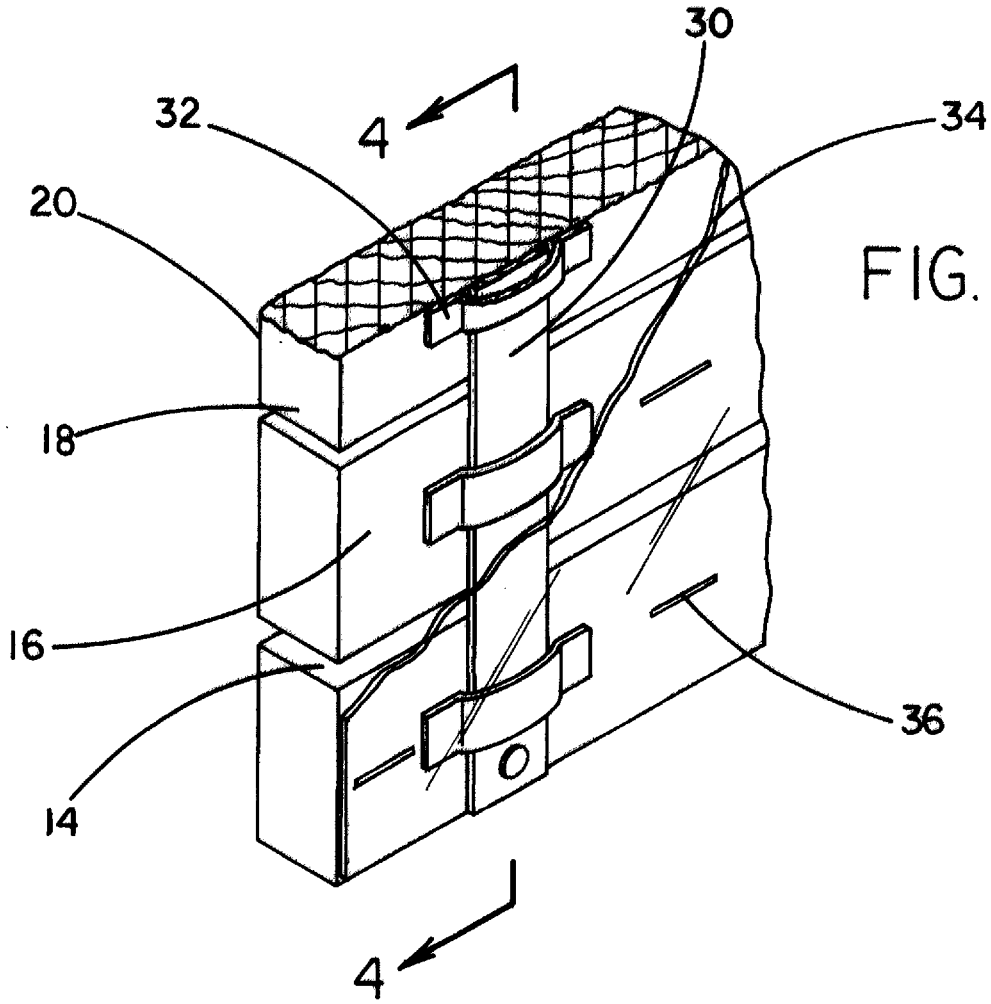
FIG. 3
FIG. 4
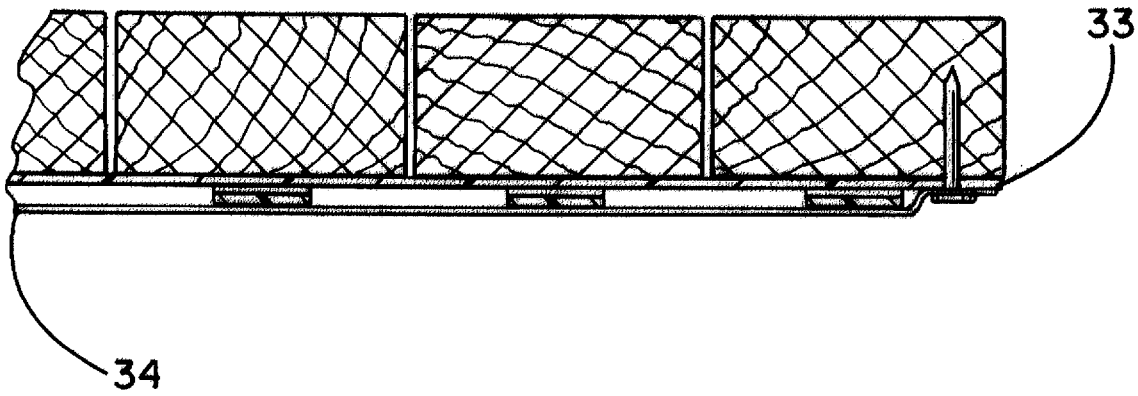

POSTAL BOX COVERING

BACKGROUND OF THE INVENTION

1. Field of the Invention

The present invention relates to coverings and more particularly pertains to a new postal box covering for protecting a postal box from the elements of weather.

2. Description of the Prior Art

The use of coverings is known in the prior art. More specifically, coverings heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,035,356; 5,435,483; 5,106,016; 4,368,842; 3,107,848; and U.S. Pat. Des. No. 256,751.

While these devices fulfill their respective, particular objectives and requirements, the aforementioned patents do not disclose a new postal box covering. The inventive device includes a plurality of elongate members. Each of the elongate members has a longitudinal axis. Each of the elongate members has a first side, a second side, a third side, a fourth side, a first end and a second end. The elongate members are generally oriented parallel to each other. The elongate members are between a first and a second elongate member. A plurality of straps bind the elongate members together. Each of the straps is adjacent to each of the second sides of the elongate members. A plurality of fastening devices fasten the straps to the elongate members. A plurality of mountings are fixedly coupled to the first and second elongate members. A plurality of brackets have a base portion and two arm members extending therefrom. The arm members are oriented generally parallel to each other and are spaced. One of the arm members is releasably coupled to each of the mountings.

In these respects, the postal box covering according to the present invention substantially departs from the conventional concepts and designs of the prior art, and in so doing provides an apparatus primarily developed for the purpose of protecting a postal box from the elements of weather.

SUMMARY OF THE INVENTION

In view of the foregoing disadvantages inherent in the known types of coverings now present in the prior art, the present invention provides a new postal box covering construction wherein the same can be utilized for protecting a postal box from the elements of weather.

The general purpose of the present invention, which will be described subsequently in greater detail, is to provide a new postal box covering apparatus and method which has many of the advantages of the coverings mentioned heretofore and many novel features that result in a new postal box covering which is not anticipated, rendered obvious, suggested, or even implied by any of the prior art coverings, either alone or in any combination thereof.

To attain this, the present invention generally comprises a plurality of elongate members. Each of the elongate members has a longitudinal axis. Each of the elongate members has a first side, a second side, a third side, a fourth side, a first end and a second end. The elongate members are generally oriented parallel to each other. The elongate members are between a first and a second elongate member. A plurality of straps bind the elongate members together. Each of the straps is adjacent to each of the second sides of the elongate members. A plurality of fastening devices fasten the straps to the elongate members. A plurality of mountings are fixedly coupled to the first and second elongate members. A plurality of brackets have a base portion and two arm members extending therefrom. The arm members are oriented generally parallel to each other and are spaced. One of the arm members is releasably coupled to each of the mountings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new postal box covering apparatus and method which has many of the advantages of the coverings mentioned heretofore and many novel features that result in a new postal box covering which is not anticipated, rendered obvious, suggested, or even implied by any of the prior art coverings, either alone or in any combination thereof.

It is another object of the present invention to provide a new postal box covering which may be easily and efficiently manufactured and marketed.

It is a further object of the present invention to provide a new postal box covering which is of a durable and reliable construction.

An even further object of the present invention is to provide a new postal box covering which is susceptible of a low cost of manufacture with regard to both materials and labor, and which accordingly is then susceptible of low prices of sale to the consuming public, thereby making such postal box covering economically available to the buying public.

Still yet another object of the present invention is to provide a new postal box covering which provides in the apparatuses and methods of the prior art some of the advantages thereof, while simultaneously overcoming some of the disadvantages normally associated therewith.

Still another object of the present invention is to provide a new postal box covering for protecting a postal box from the elements of weather.

Yet another object of the present invention is to provide a new postal box covering which includes a plurality of elongate members. Each of the elongate members has a longitudinal axis. Each of the elongate members has a first side, a second side, a third side, a fourth side, a first end and a second end. The elongate members are generally oriented parallel to each other. The elongate members are between a first and a second elongate member. A plurality of straps bind the elongate members together. Each of the straps is adjacent to each of the second sides of the elongate members. A plurality of fastening devices fasten the straps to the elongate members. A plurality of mountings are fixedly coupled to the first and second elongate members. A plurality of brackets have a base portion and two arm members extending therefrom. The arm members are oriented generally parallel to each other and are spaced. One of the arm members is releasably coupled to each of the mountings.

Still yet another object of the present invention is to provide a new postal box covering that can be removed easily and replaced with another covering.

Even still another object of the present invention is to provide a new postal box covering that can be painted to offer various colors to the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective view of the present invention.

FIG. 4 is a schematic cross-sectional view taken along line 4—4 of the present invention.

DESCRIPTION OF THE PREFERRED EMBODIMENT

Figure 1:
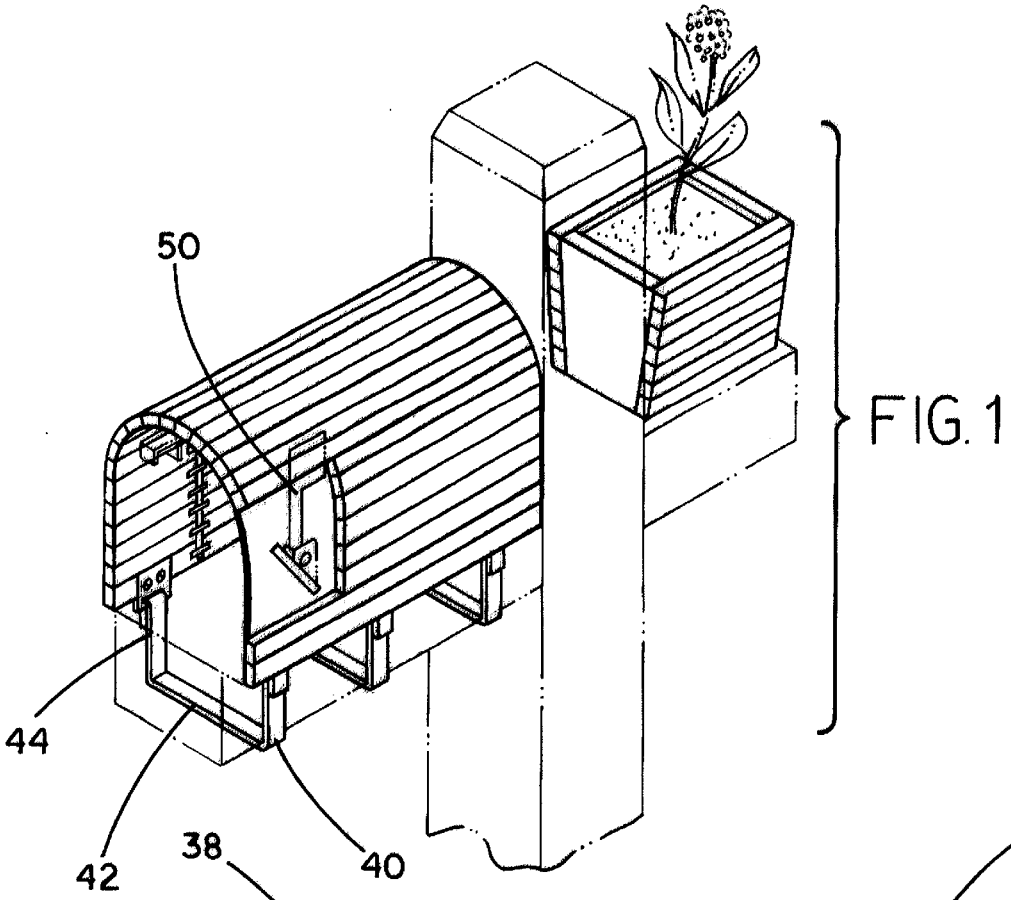
FIG. 1 is a schematic perspective view of a new postal box covering according to the present invention.

With reference now to the drawings, and in particular to FIGS. 1 through 4 thereof, a new postal box covering embodying the principles and concepts of the present invention and generally designated by the reference numeral 10 will be described.

As best illustrated in FIGS. 1 through 4, the postal box covering 10 generally comprises a plurality of elongate members 12. Each of the elongate members has a longitudinal axis. Each of the elongate members has a first side 14, a second side 16, a third side 18, a fourth side 20, a first end 22 and a second end 24. The sides of the elongate members have a generally rectangular shape. The elongate members 12 are generally oriented parallel to each other. Each of the elongate members is adjacent to each other such that each of the second sides 16 of the elongate members face one direction. The first 22 and second ends 24 of the elongate members are substantially parallel with each other. The elongate members 12 are between a first 26 and a second elongate member 28.

A plurality of straps 30 bind the elongate members 12 together. The straps 30 are adjacent to each of the second sides 16 of the elongate members. The straps are oriented generally perpendicular to the longitudinal axes of the elongate members 12. Preferably, the straps 30 are formed from rope, cord, synthetic or metallic straps.

A plurality of fastening devices 32 fastens the straps 30 to the elongate members 12. The fastening devices 32 are preferably selected from the group the comprising tacks, brackets, and staples. Preferably, nails 33 are used to fasten the end of the straps to the first 26 and second 28 elongate members.

Ideally, a protective covering 34 protects the postal box from the fastening devices 32. Preferably, the covering 34 is formed from plastic.

A plurality of fasteners 36 fixedly secure the protective covering 34 to the second sides of the elongate members. The fasteners 36 are preferably staples.

A plurality of mountings 38 are fixedly coupled to the first 26 and second elongate members 28. Each of the mountings 38 extends away from the elongate members.

A plurality of brackets 40 have a base portion 42 and two arm members 44 extending therefrom. The arm members 44 are oriented generally parallel to each other. The arm members are spaced. One of the arm members is releasably coupled to each of the mountings 38. The base portion 42 of the bracket rests against a bottom of the postal box when the arm members 44 are coupled to the mountings 38.

Figure 2:
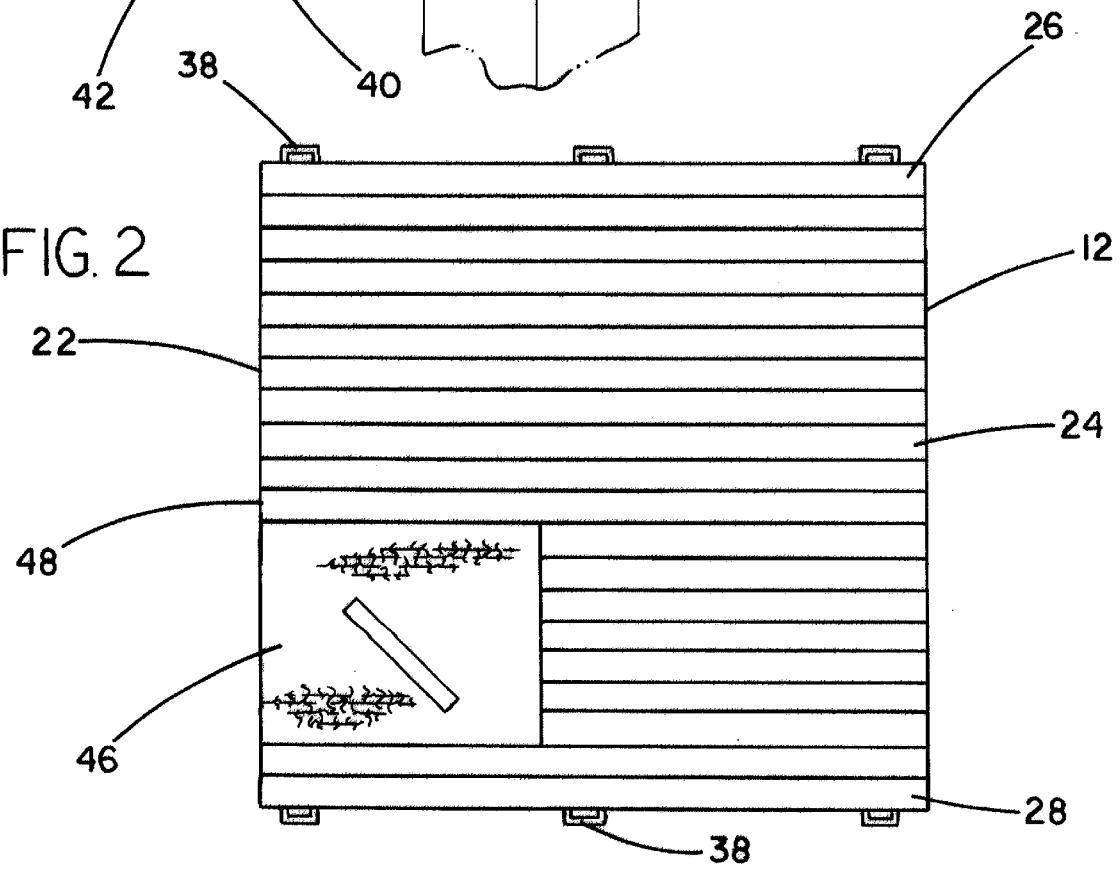
FIG. 2 is a schematic plan view of the present invention.

The covering 10 has a section 46 removed to expose a flag 50 on the postal box. The covering has a generally rectangular shape when the covering is laying in a horizontal orientation, as is best depicted in FIG. 2. The covering has a first, second, third and fourth edges, wherein a first and a second of the edges are two opposite ends. The first and second edges are the first 26 and second 28 elongate members. The section is removed from the third edge 48, and is located generally adjacent to the second edge 28. The third edge is formed from the alignment of the first ends of the elongate members. Preferably, the section 46 is generally rectangular shaped.

In use, the covering 10 is placed over the postal box with the protective covering 34 against the postal box. The removed section 46 is aligned with the flag 50 of the postal box. The brackets 42 are coupled to the mountings 38 to hold the covering in place.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A covering for a postal box, said covering comprising:

a plurality of elongate members, each of said elongate members having a longitudinal axis, each of said elongate members having a first side, a second side, a third side, a fourth side, a first end and a second end, each of said elongate members being generally oriented parallel to each other; wherein each of said elongate members are between a first and a second elongate member;

a plurality of straps for binding said elongate members together, each of said straps being adjacent to each of said second sides of said elongate members;

a plurality of fastening devices for fastening said straps to said elongate members;

a plurality of mountings, said mountings being fixedly coupled to said first and second elongate members;

a plurality of brackets, each of said brackets having a base portion and two arm members extending therefrom, said arm members being oriented generally parallel to each other, said arm members being spaced, wherein one of said arm members is releasably coupled to each of said mountings.

2. The covering for a postal box as in claim 1, wherein said elongate members comprise:

each side of said elongate members having a generally rectangular shape, each of said elongate members being adjacent to each other such that each of said second sides of said elongate members face one direction, each of said first and second ends of said elongate members being substantially parallel with each other.

3. The covering for a postal box as in claim 1, wherein said straps are selected from the group comprising rope, cord, synthetic and metal bands.

4. The covering for a postal box as in claim 1, wherein said fastening devices being selected from the group the comprising tacks, brackets, and staples.

5. The covering for a postal box as in claim 1, further including:

a protective covering for protecting said postal box from said fastening devices, said covering being formed from plastic; and a plurality of fasteners for fixedly securing said protective covering to said second sides of said elongate members, wherein said fasteners comprises staples.

6. The covering for a postal box as in claim 5, wherein said mountings and brackets comprise:

each of said mountings extending away from said elongate members; and each of said base portions of said brackets adapted to rest against a bottom of said postal box when said arm members are coupled to said mountings.

7. The covering for a postal box as in claim 6, further comprising:

wherein said covering has a section removed to expose a flag on said postal box, said covering having a generally rectangular shape when said covering is laying horizontal, said covering having a first, second, third and fourth edges, wherein said first and second edges are two opposite ends of said cover, wherein said first and second edges are said first and second elongate members, said section being removed from said third edge, said section being located generally adjacent to said second edge, said section being generally rectangular.

8. A covering for a postal box, said covering comprising:

a plurality of elongate members, each of said elongate members having, a longitudinal axis, each of said elongate members having a first side, a second side, a third side, a fourth side, a first end and a second end, each side of said elongate members having, a generally rectangular shape, each of said elongate members being generally oriented parallel to each other, each of said elongate members being adjacent to each other such that each of said second sides of said elongate members face one direction, each of said first and second ends of said elongate members being substantially parallel with each other, wherein each of said elongate members are between a first and a second elongate member;

a plurality of straps for binding said elongate members together, each of said straps being adjacent to each of said second sides of said elongate members, each of said straps being oriented generally perpendicular said longitudinal axes of said elongate members;

a plurality of fastening devices for fastening said straps to said elongate members, said fastening devices being selected from the group the comprising tacks, brackets, and staples;

a protective covering for protecting said postal box from said fastening devices, said covering being formed from plastic;

a plurality of fasteners for fixedly securing said protective covering to said second sides of said elongate members, wherein said fasteners comprises staples;

a plurality of mountings, said mountings being fixedly coupled to said first and second elongate members, each of said mounting extending away from said elongate members;

a plurality of brackets, each of said brackets having a base portion and two arm members extending therefrom, said arm members being oriented generally parallel to each other, said arm members being spaced, wherein one of said arm members is releasably coupled to each of said mountings, wherein said base portion of said bracket is adapted to rest against a bottom of said postal box when said arm members are coupled to said mountings; and wherein said covering has a section removed to expose a flag on said postal box, said covering having a generally rectangular shape when said covering is laying horizontal, said covering having a first, second, third and fourth edges, wherein said first and second edges are two opposite ends of said covering, wherein said first and second edges are said first and second elongate members, said section being removed from said third edge, said section being located generally adjacent to said second edge, said section being generally rectangular.

* * * * *